US010762733B2

(12) United States Patent
Bergdale et al.

(10) Patent No.: US 10,762,733 B2
(45) Date of Patent: Sep. 1, 2020

(54) METHOD AND SYSTEM FOR ELECTRONIC TICKET VALIDATION USING PROXIMITY DETECTION

(71) Applicant: Bytemark, Inc., New York, NY (US)

(72) Inventors: Micah Bergdale, New York, NY (US); Nicholas Ihm, New York, NY (US); Matthew Grasser, New York, NY (US)

(73) Assignee: BYTEMARK, INC.

( * ) Notice: Subject to any disclaimer, the term of this patent is extended or adjusted under 35 U.S.C. 154(b) by 0 days.

(21) Appl. No.: 14/496,645

(22) Filed: Sep. 25, 2014

(65) Prior Publication Data

US 2015/0084741 A1 Mar. 26, 2015

Related U.S. Application Data

(60) Provisional application No. 61/883,097, filed on Sep. 26, 2013.

(51) Int. Cl.
*G07C 9/28* (2020.01)
*G07C 9/27* (2020.01)
(Continued)

(52) U.S. Cl.
CPC ..... *G07C 9/28* (2020.01); *G07C 9/27* (2020.01); *G07C 9/29* (2020.01); *G07B 15/00* (2013.01); *G07C 9/10* (2020.01)

(58) Field of Classification Search
CPC ..... G07B 15/00; G07B 15/02; G07B 5/04; G07C 9/00111; G07C 9/02; G07C 9/00103; G07C 9/00087; G07C 2209/08; G07C 9/00; G07C 9/00007; G07C 9/00119; G07C 11/00; G07C 9/00158; G07C 9/00309; G07C 2009/00793; G07C 2011/02;
(Continued)

(56) References Cited

U.S. PATENT DOCUMENTS 4,193,114 A 3/1980 Benini
5,253,166 A 10/1993 Dettelbach
(Continued)

FOREIGN PATENT DOCUMENTS

EP 1439495 A1 7/2004
GB 2390211 12/2003
(Continued)

OTHER PUBLICATIONS

Starnberger et al., "QR-TAN: Secure Mobile Transaction Authentication," area, pp. 578-583, 2009 International Conference on Availability, Reliability and Security, 2009.
(Continued)

*Primary Examiner* — Emily C Terrell
(74) *Attorney, Agent, or Firm* — Jennifer Meredith, Esq.; Meredith Attorneys, PLLC

(57) ABSTRACT

This invention discloses a novel system and method for automated protocols between a mobile device and an electronic ticketing verification system, where proximity detection is used to automatically display the verification or to automatically control entry gates or turnstiles when the mobile device is verified has holding a valid ticket and being located in a specific location associated with the ticket.

6 Claims, 13 Drawing Sheets

(51) Int. Cl.
*G07C 9/29* (2020.01)
*G07B 15/00* (2011.01)
*G07C 9/10* (2020.01)

(58) Field of Classification Search
CPC ..... G07C 9/00031; G07C 9/00571; G07C 15/006; G07C 2009/00317; G07C 2009/00388; G07C 2009/00476; G07C 2009/00555; G07C 2009/00769; G07C 2009/00777; G07C 2009/00865; G07C 2011/04; G07C 2209/63; G07C 9/00015; G07C 9/00166; G07C 9/00857; G07C 9/025; G06F 2221/2151; G06F 21/35; G06F 2221/2111; G06F 2221/2137; G06F 21/445; G06F 2221/2103; G06F 2221/2129; G06F 21/42; G06F 3/042; G06K 19/0723; G06K 17/0022; G06K 17/0029; G06K 19/07758; G06K 7/10297; G06K 19/0712; G06K 7/10386; G06Q 20/327; G06Q 20/40; G06Q 20/322; G06Q 10/02; G06Q 20/3224; G06Q 20/3278; G06Q 30/0261; H04L 63/0492; H04L 63/107; H04W 4/008; H04W 4/021
USPC ..... 340/5.61, 5.65, 5.7, 5.74, 5.64, 5.8–5.86
See application file for complete search history.

(56) References Cited

U.S. PATENT DOCUMENTS 5,465,084 A 11/1995 Cottrell
5,559,961 A 9/1996 Blonder
5,590,038 A 12/1996 Pitroda
5,621,797 A 4/1997 Rosen
5,777,305 A 7/1998 Smith
5,789,732 A 8/1998 McMahon
5,797,330 A 8/1998 Li
5,907,830 A 5/1999 Engel
5,918,909 A 7/1999 Fiala
6,023,679 A 2/2000 Acebo
6,023,688 A 2/2000 Ramachandran
6,085,976 A 7/2000 Sehr
6,175,922 B1 1/2001 Wang
6,251,017 B1 6/2001 Leason
6,315,195 B1 11/2001 Ramachandran
6,373,587 B1 4/2002 Sansone
6,393,305 B1 5/2002 Ulvinen
6,454,174 B1 9/2002 Sansone
6,473,739 B1 10/2002 Showghi
6,484,182 B1 11/2002 Dunphy
6,493,110 B1 12/2002 Roberts
6,496,809 B1 12/2002 Nakfoor
6,685,093 B2 2/2004 Challa
6,775,539 B2 8/2004 Deshpande
6,961,858 B2 11/2005 Fransdonk
6,997,384 B2 2/2006 Hara
7,017,806 B2 3/2006 Peterson
7,020,635 B2 3/2006 Hamilton
7,024,807 B2 4/2006 Street
7,044,362 B2 5/2006 Yu
7,080,049 B2 7/2006 Truitt
7,090,128 B2 8/2006 Farley
7,093,130 B1 8/2006 Kobayashi
7,103,572 B1 9/2006 Kawaguchi
7,107,462 B2 9/2006 Fransdonk
7,134,087 B2 11/2006 Bushold
7,150,045 B2 12/2006 Koelle
7,158,939 B2 1/2007 Goldstein
7,174,462 B2 2/2007 Pering
7,191,221 B2 3/2007 Schatz
7,263,506 B2 8/2007 Lee
7,315,944 B2 1/2008 Dutta
7,386,517 B1 6/2008 Donner
7,392,226 B1 6/2008 Sasaki
7,395,506 B2 7/2008 Tan
7,493,261 B2 2/2009 Chen
7,520,427 B2 4/2009 Boyd
7,529,934 B2 5/2009 Fujisawa
7,555,284 B2 6/2009 Yan
7,567,910 B2 7/2009 Hasegawa
7,587,502 B2 9/2009 Crawford
7,617,975 B2 11/2009 Wada
7,711,586 B2 5/2010 Aggarwal
7,933,589 B1 4/2011 Mamdani
7,967,211 B2 6/2011 Challa
8,010,128 B2 8/2011 Silverbrook
8,016,187 B2 9/2011 Frantz
8,019,365 B2 9/2011 Fisher
8,333,317 B2 * 12/2012 Buer ..... G07C 9/00007 235/380
8,370,180 B2 2/2013 Scott
8,379,874 B1 2/2013 Simon
8,457,354 B1 6/2013 Kolar
8,473,342 B1 6/2013 Roberts
8,494,967 B2 7/2013 Bergdale
8,583,511 B2 11/2013 Hendrickson
8,584,224 B1 11/2013 Pei
8,788,836 B1 7/2014 Hernacki
8,881,252 B2 * 11/2014 Van Till ..... H04L 63/08 726/7
8,912,879 B2 * 12/2014 Fyke ..... G06F 21/35 340/5.1
8,935,802 B1 1/2015 Mattsson
9,152,279 B2 10/2015 Moberg
9,239,993 B2 1/2016 Bergdale
2001/0005840 A1 6/2001 Verkama
2001/0014870 A1 8/2001 Saito
2001/0016825 A1 8/2001 Pugliese
2001/0037174 A1 11/2001 Dickerson
2001/0044324 A1 11/2001 Carayiannis
2001/0051787 A1 12/2001 Haller
2001/0052545 A1 12/2001 Serebrennikov
2001/0054111 A1 12/2001 Lee
2002/0010603 A1 * 1/2002 Doi ..... G06Q 10/02 705/5
2002/0016929 A1 2/2002 Harashima
2002/0023027 A1 2/2002 Simonds
2002/0040308 A1 4/2002 Hasegawa
2002/0040346 A1 4/2002 Kwan
2002/0060246 A1 5/2002 Gobburu
2002/0065713 A1 5/2002 Awada
2002/0065783 A1 5/2002 Na
2002/0090930 A1 7/2002 Fujiwara
2002/0094090 A1 7/2002 Iino
2002/0126780 A1 9/2002 Oshima
2002/0138346 A1 9/2002 Kodaka
2002/0145505 A1 * 10/2002 Sata ..... G07B 15/00 340/5.2
2002/0184539 A1 12/2002 Fukuda
2002/0196274 A1 12/2002 Comfort
2003/0036929 A1 2/2003 Vaughan
2003/0066883 A1 4/2003 Yu
2003/0069763 A1 4/2003 Gathman
2003/0069827 A1 4/2003 Gathman
2003/0093695 A1 5/2003 Dutta
2003/0105641 A1 6/2003 Lewis
2003/0105954 A1 6/2003 Immonen
2003/0105969 A1 6/2003 Matsui
2003/0154169 A1 8/2003 Yanai
2003/0163787 A1 8/2003 Hay
2003/0172037 A1 9/2003 Jung
2003/0200184 A1 10/2003 Dominguez
2003/0229790 A1 12/2003 Russell
2003/0233276 A1 12/2003 Pearlman
2004/0019564 A1 1/2004 Goldthwaite
2004/0019792 A1 1/2004 Funamoto
2004/0030081 A1 2/2004 Hegi
2004/0030091 A1 2/2004 McCullough
2004/0030658 A1 2/2004 Cruz
2004/0039635 A1 2/2004 Linde
2004/0085351 A1 5/2004 Tokkonen

(56) References Cited

U.S. PATENT DOCUMENTS

2004/0101158 A1 5/2004 Butler
2004/0111373 A1 6/2004 Iga
2004/0128509 A1 7/2004 Gehrmann
2004/0148253 A1 7/2004 Shin
2004/0157559 A1* 8/2004 Sugikawa ..... H04W 8/005 455/41.2
2004/0169589 A1 9/2004 Lea
2004/0186884 A1 9/2004 Dutordoir
2004/0210476 A1 10/2004 Blair
2004/0224703 A1 11/2004 Takaki
2004/0250138 A1 12/2004 Schneider
2005/0059339 A1 3/2005 Honda
2005/0060554 A1 3/2005 ODonoghue
2005/0070257 A1 3/2005 Saarinen
2005/0108912 A1 5/2005 Bekker
2005/0109838 A1 5/2005 Linlor
2005/0111723 A1 5/2005 Hannigan
2005/0116030 A1 6/2005 Wada
2005/0137889 A1 6/2005 Wheeler
2005/0204140 A1 9/2005 Maruyama
2005/0212760 A1 9/2005 Marvit
2005/0240589 A1 10/2005 Altenhofen
2005/0246634 A1 11/2005 Ortwein
2005/0252964 A1* 11/2005 Takaki ..... G07B 15/063 235/382
2005/0253817 A1 11/2005 Rytivaara
2005/0272473 A1 12/2005 Sheena
2005/0283444 A1* 12/2005 Ekberg ..... G06Q 20/02 705/67
2006/0120607 A1 6/2006 Lev
2006/0161446 A1 7/2006 Fyfe
2006/0174339 A1 8/2006 Tao
2006/0206724 A1 9/2006 Schaufele
2006/0206728 A1 9/2006 Masuda
2006/0206926 A1 9/2006 Luo
2006/0293929 A1 12/2006 Wu
2007/0012765 A1 1/2007 Trinquet
2007/0017979 A1 1/2007 Wu
2007/0022058 A1 1/2007 Labrou
2007/0032225 A1 2/2007 Konicek
2007/0136213 A1 6/2007 Sansone
2007/0150842 A1 6/2007 Chaudhri
2007/0156443 A1 7/2007 Gurvey
2007/0192590 A1 8/2007 Pomerantz
2007/0215687 A1 9/2007 Waltman
2007/0260543 A1 11/2007 Chappuis
2007/0265891 A1 11/2007 Guo
2007/0271455 A1 11/2007 Nakano
2007/0273514 A1 11/2007 Winand
2007/0276944 A1 11/2007 Samovar
2007/0283049 A1 12/2007 Rakowski
2007/0288319 A1 12/2007 Robinson
2008/0007388 A1 1/2008 Au
2008/0071587 A1 3/2008 Granucci
2008/0071637 A1 3/2008 Saarinen
2008/0120127 A1 5/2008 Stoffelsma
2008/0120186 A1 5/2008 Jokinen
2008/0154623 A1* 6/2008 Derker ..... G07B 15/00 705/1.1
2008/0191009 A1 8/2008 Gressel
2008/0191909 A1 8/2008 Mak
2008/0201212 A1 8/2008 Hammad
2008/0201576 A1 8/2008 Kitagawa
2008/0201769 A1 8/2008 Finn
2008/0227518 A1 9/2008 Wiltshire
2008/0238799 A1* 10/2008 Tsushima ..... H01Q 1/2216 343/788
2008/0263077 A1 10/2008 Boston
2008/0288302 A1 11/2008 Daouk
2008/0308638 A1 12/2008 Hussey
2009/0055288 A1 2/2009 Nassimi
2009/0083184 A1 3/2009 Eisen
2009/0088077 A1 4/2009 Brown
2009/0125387 A1 5/2009 Mak
2009/0222900 A1 9/2009 Benaloh
2009/0284482 A1 11/2009 Chin
2010/0017872 A1 1/2010 Goertz
2010/0044444 A1 2/2010 Jain
2010/0082491 A1* 4/2010 Rosenblatt ..... G06Q 10/02 705/65
2010/0121766 A1 5/2010 Sugaya
2010/0201536 A1 8/2010 Robertson
2010/0211452 A1 8/2010 DAngelo
2010/0219234 A1 9/2010 Forbes
2010/0228563 A1 9/2010 Walker, Jr.
2010/0228576 A1 9/2010 Marti
2010/0253470 A1* 10/2010 Burke ..... G06K 9/00885 340/5.82
2010/0268649 A1 10/2010 Roos
2010/0274691 A1 10/2010 Hammad
2010/0279610 A1 11/2010 Bjorhn
2010/0306718 A1 12/2010 Shim
2010/0308959 A1 12/2010 Schorn
2010/0322485 A1 12/2010 Riddiford
2011/0001603 A1* 1/2011 Willis ..... G07C 9/00039 340/5.2
2011/0040585 A1 2/2011 Roxburgh
2011/0068165 A1 3/2011 Dabosville
2011/0078440 A1 3/2011 Feng
2011/0136472 A1 6/2011 Rector
2011/0153495 A1* 6/2011 Dixon ..... G06Q 20/10 705/39
2011/0208418 A1 8/2011 Looney
2011/0251910 A1 10/2011 Dimmick
2011/0283241 A1 11/2011 Miller
2011/0307381 A1 12/2011 Kim
2011/0311094 A1 12/2011 Herzog
2012/0006891 A1 1/2012 Zhou
2012/0030047 A1 2/2012 Fuentes
2012/0092190 A1 4/2012 Stefik
2012/0129503 A1 5/2012 Lindeman
2012/0133484 A1 5/2012 Griffin
2012/0136698 A1 5/2012 Kent
2012/0166298 A1 6/2012 Smith
2012/0245769 A1 9/2012 Creissels
2012/0330697 A1* 12/2012 Smith ..... G06Q 10/02 705/5
2013/0103200 A1 4/2013 Tucker
2013/0124236 A1 5/2013 Chen
2013/0194202 A1 8/2013 Moberg
2013/0204647 A1 8/2013 Behun
2013/0214906 A1* 8/2013 Wojak ..... H04W 4/008 340/10.1
2013/0279757 A1 10/2013 Kephart
2013/0307990 A1 11/2013 Wiles
2014/0086125 A1 3/2014 Polo
2014/0100896 A1 4/2014 Du
2014/0156318 A1 6/2014 Behun
2014/0186050 A1 7/2014 Oshima
2014/0279558 A1 9/2014 Kadi
2015/0025921 A1 1/2015 Smith
2015/0084741 A1 3/2015 Bergdale
2015/0213443 A1 7/2015 Geffon
2015/0213660 A1 7/2015 Bergdale
2015/0317841 A1 11/2015 Karsch
2015/0365791 A1* 12/2015 Morgner ..... H04L 9/0872 455/456.3
2016/0042631 A1 2/2016 Ho
2016/0055605 A1 2/2016 Kim
2016/0093127 A1 3/2016 Evans
2016/0358391 A1 12/2016 Drako
2017/0055157 A1 2/2017 Bergdale
2017/0372289 A1 12/2017 Fitzsimmons

FOREIGN PATENT DOCUMENTS

GB 2417358 2/2006
JP H11145952 A 5/1999
JP 2003187272 A 7/2003
RU 94931 6/2010
TW 200825968 A 6/2008
WO 2007139348 A1 12/2007

(56) References Cited

FOREIGN PATENT DOCUMENTS

| | | |
|---|---|---|
| WO | 2008113355 | 9/2008 |
| WO | 2009141614 | 11/2009 |
| WO | 2011044899 | 4/2011 |
| WO | 2014043810 | 3/2014 |
| WO | 2014189068 | 11/2014 |
| WO | 2016105322 | 6/2016 |

OTHER PUBLICATIONS

Scott Boyter, "Aeritas tried to fill void until 3G wireless is ready; Mobile boarding pass is just one application being tested", all pages, Dallaw Forth Worth TechBiz, Feb. 19, 2001.
Joanna Elachi, "Lufthansa Debuts Barcode Check-in and Boarding", all pages, CommWeb.com, May 25, 2001.
"Aeritas launches secure wireless check-in with barcode", all pages, m-Travel.com, Nov. 9, 2001.
"Aeritas Launches Wireless Check-in and Security Service", all pages, MBusiness Daily, Nov. 8, 2001.
"New Fast Track Wireless Check-In and Security Solution", all pages, aerias.com, retrieved Feb. 5, 2002.
Hussin, W.H.; Coulton, P; Edwards, R., "Mobile ticketing system employing TrustZone technology" Jul. 11-13, 2005.
Jong-Sik Moon; Sun-Ho Lee; lm-Yeong Lee; Sang-Gu Byeon, "Authentication Protocol Using Authorization Ticket in Mobile Network Service Environment" Aug. 11-13, 2010.
Stephanie Bell, "UK Rail Network to Launch Mobile Train-Ticketing Application" Cardline, Feb. 4, 2011.
Ko Fujimura, Yoshiaki Nakajima, Jun Sekine: "XML Ticket: Generalized Digital Ticket Definition Language" Proceedings of the 3rd Usenix Workshop on Electronic Commerce, Sep. 3, 1998.
Chun-Te Chen; Te Chung Lu, "A mobile ticket validation by VSS teach with timestamp" Mar. 28-31, 2004.
Improvement of urban passenger transport ticketing systems by deploying intelligent transport systems, 2006.
Machine English translation of JP2003-187272A from U.S. Appl. No. 13/901,243.
Search report from PCT/US18/56829 dated Mar. 7, 2019.
The Hindustan Times "Computerised Rail Reservation" New Delhi; Nov. 28, 2007 (Year: 2007).
Search Report from PCT/2018/031552 dated Oct. 3, 2018.
Search report from PCT/US17/56723 dated Jan. 2, 2018.
Search report from PCT/US16/45516 dated Oct. 24, 2016.
EDTX Case 2:16-cv-00543 Judgment dated as filed Feb. 7, 2019.
EDTX Case 2:16-cv-00543 Report and recommendation dated as filed Nov. 26, 2018.
US Court of Appeals for Federal Circuit Brief for Appellant filed Apr. 29, 2019 (Case No. 2019-1442).
US Court of Appeals for Federal Circuit Brief for Appellee filed Jun. 10, 2019 (Case No. 19-1442).
U.S. Court of Appeals for Federal Circuit Reply Brief for Appellant filed Jul. 1, 2019 (Case No. 2019-1442).
U.S. Pat. No. 9,239,993.
U.S. Pat. No. 8,494,967.

* cited by examiner

Figure 9

| |
|---|
| Venue ID |
| Username |
| Password |
| Token |

METHOD AND SYSTEM FOR ELECTRONIC TICKET VALIDATION USING PROXIMITY DETECTION

This application incorporates by reference U.S. patent application Ser. No. 13/901,243, filed on May 23, 2013. This application claims priority to U.S. Provisional App. No. 61/883,097 filed Sep. 26, 2013, which is incorporated by reference.

FIELD OF INVENTION

This invention provides a mechanism whereby a venue or other facility that meters usage by means of tickets can distribute tickets electronically and use proximity detection of the device location as part of a verification to either authorize the display of the visual confirmation or to electronically control an entry gateway mechanism.

BACKGROUND

Venues such as theaters, amusement parks and other facilities that use tickets, for example airlines, ferries and other transportation have a need to use electronic ticketing. Existing systems distribute information that can constitute a ticket, but the verification problem is difficult. In one example of prior art, an electronic ticket is displayed as a bar-code on the recipient's telephone display screen. The telephone is then placed on a scanner that reads the bar-code in order to verify the ticket. The problem with these systems is that the scanning process is fraught with error and the time taken to verify the electronic ticket far exceeds that of the old system: looking at the paper ticket and tearing it in half. Barcode scanners were not designed to read a lit LCD screen displaying a bar code. The reflectivity of the screen can defeat the scanning process. Therefore, there is a need for an electronic ticketing system that provides a proximity based way that the venue can rely on to verify that the person possesses a valid ticket. This invention provides for the distribution of an electronic ticket that also contains a verification mechanism of using the proximity of the user's device to verify that the ticket valid.

DETAILED DESCRIPTION OF THE PREFERRED EMBODIMENTS

Figure 1:
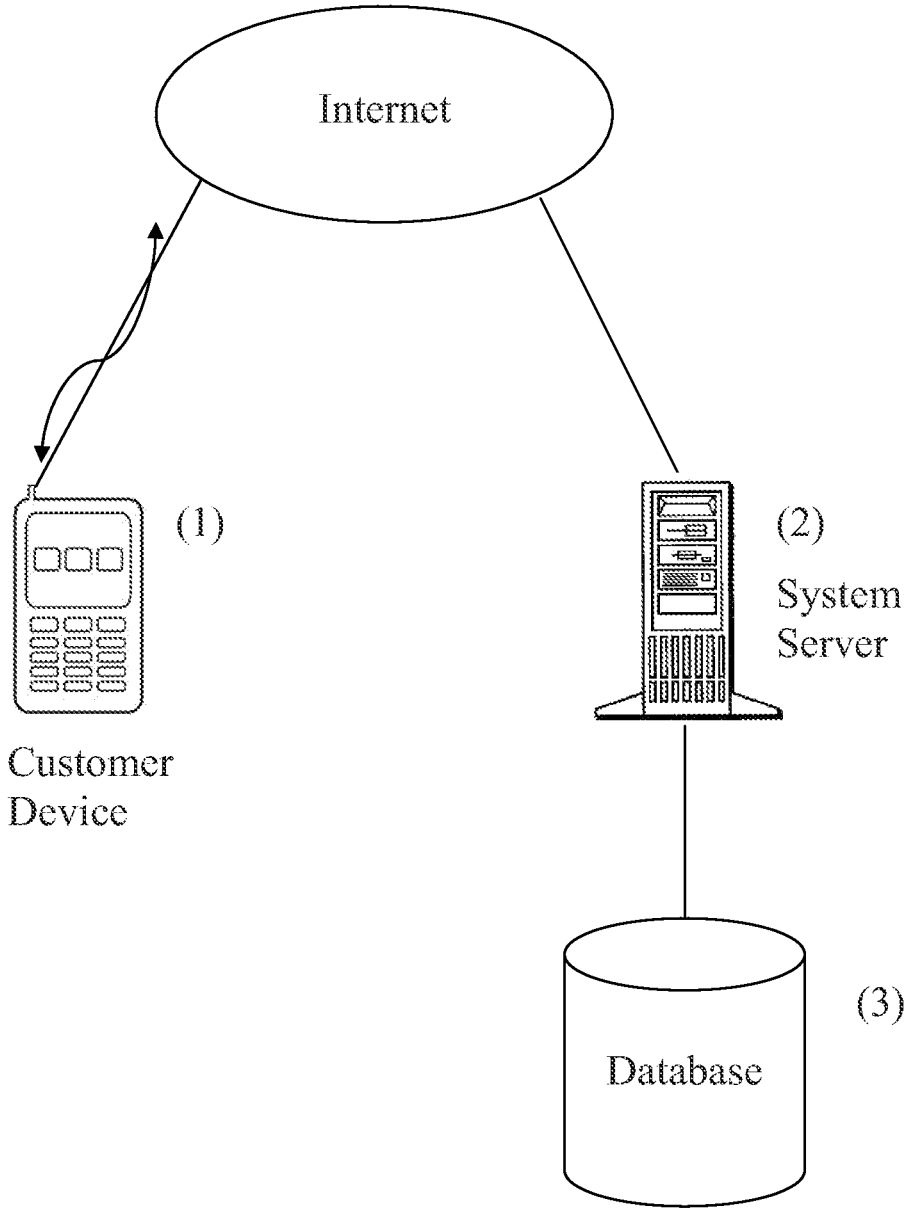
FIG. 1. Electronic ticketing components diagram
FIG. 2. Electronic ticketing process flow chart
FIG. 3. Electronic ticket verification protocol diagram
FIG. 4. Electronic ticket proximity verification flow chart
FIG. 5. Proximity detection with entry device diagram
FIG. 6. Proximity detection with electronic ticketing system diagram
FIG. 7. Proximity ticket validation process flow chart
FIG. 8. Basic electronic ticket data structure diagram
FIG. 9. Basic user identifier data structure diagram
FIG. 10. Flow chart for persistent channel delivery of electronic ticket diagram.
Figure 6:
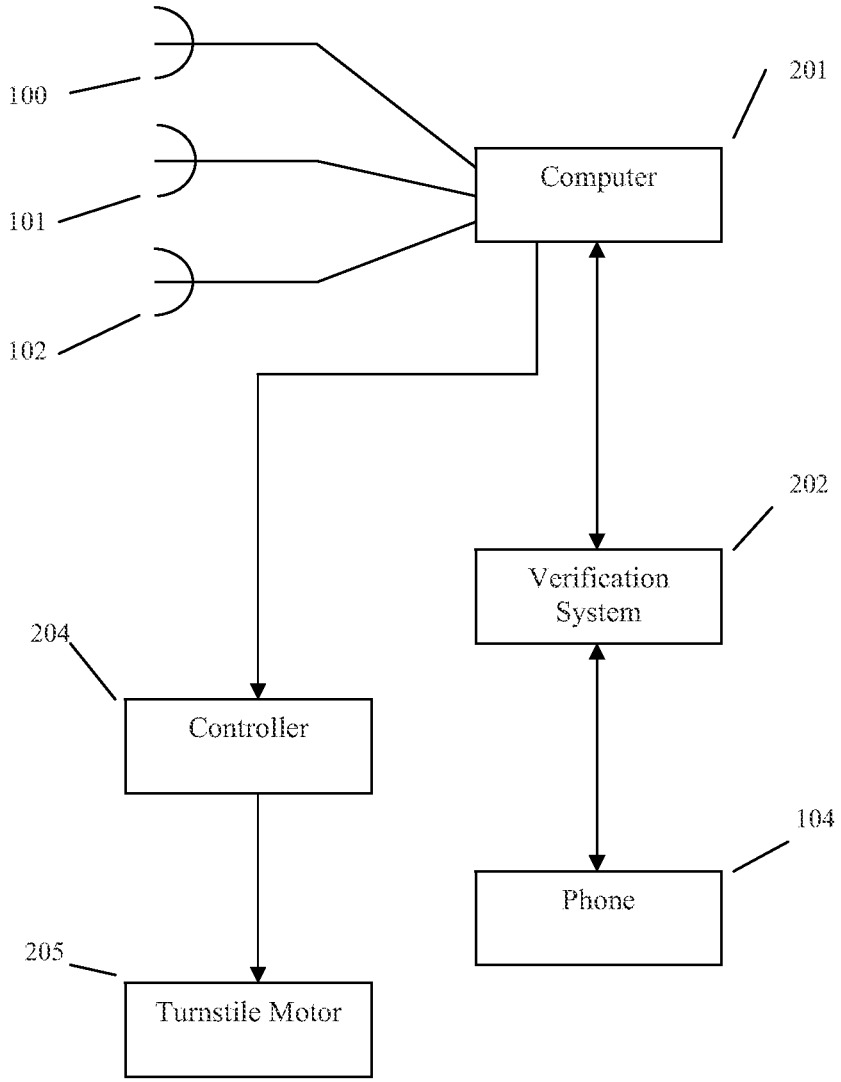

The system operates on one or more computers, typically one or more file servers connected to the Internet and also on a customer's computing device. FIG. 1. In addition, the system is comprised of one or more radio frequency sensors that are coupled to a computer that is also connected to the file servers. FIG. 6. A customer's device can be a personal computer, mobile phone, mobile handheld device like a Blackberry™ or iPhone™ or any other kind of computing device a user can use to send and receive data messages. Preferrably, the user's device also has a Bluetooth or WiFi capability that is active.

The invention is directed to a system that determines ticket validity based on a proximity analysis algorithm that determines that the mobile phone or other portable device used by the consumer has a valid pass for entry into a venue, event or mode of transport, and that the person has a valid entry pass to go through the turnstile or other entry port mechanism where the device is present. This process occurs without the need to present the cell phone to a ticket taker and without the need for the mobile device owner to do anything at the point of entry other than to have the device turned on with Bluetooth LE or some other wireless transceiver mode turned on. The invention uses enhanced proximity awareness along with user/account/device validation communications that occurs around the use of mobile electronic ticketing processes for entry or exit.

The system is comprised of two or more bluetooth le or other wireless proximity sensors, e.g. antennas, used to determine shared proximity. FIG. 6. Shared proximity means that the data from all the sensors indicates that the same mobile device is present at a pre-determined location relative to the predetermined locations of the sensors, for example, the center of a turnstile. The detection data from the proximity detecting antennas is transmitted to a computer that uses the data to determine the exact location of the mobile device. This works in a manner similar to triangulation, but the number of sensors is not necessarily limited to three sensors. By placing proximity sensors at and around a turnstile (see FIG. 5, 101, 102, 100), a user can be validated as a legitimate pass/ticket holder without the need to scan a piece of paper or present the phone to a ticket taker or a barcode reading device.

The algorithm requires the sensors to communicate with one another and a computer either locally or to each communicate with a server, whereby the computer or server is used to determine whether the ticket holder meets the required criteria for a valid pass holder. In this embodiment, the portable device is actuated in order that the system controlling the proximity detectors may then take a reading measuring the location of the device. The multiple sensors allow for ticketed passengers to enter into a virtual box to determine exact perimeters and centralization of the phone to make sure the person with the valid pass/ticket is the actual person about to enter the gate. 103 Different ways of calculating or determining location may be used. In one embodiment, each the sensors determine the approximate distance of the same mobile device to each sensor by measuring signal intensity. In another embodiment, the relative intensity of the sensors determines location, that is, the ratio of signal intensities. In yet another embodiment, each sensor receives a periodic signal transmitted from the device and measures the exact time of its arrival at the sensor. The central servers controlling all sensors then receives this timing data and uses the relative timing data to determine whether the device is within the virtual box.

Geometric calculations based on the predetermined location of the sensors will result in the location of the mobile device. In another embodiment, the sensor sensitivity profile may have a shape that results in a signal of a certain set of strengths at all corresponding sensors that only occurs when the mobile device is at a predetermined location relative to the sensors. This may be determined empirically for a specific layout of sensors. The empirical result may be stored as a profile that defines a function that describes device location as a function of the measured signal intensities from each sensor. A third methodology is to combine location detection methods. For example, a light beam or ultrasonic sensor connected to the system may be tripped by the presence of the person to indicate that a person is within the virtual box. At that instant, the sensor may be only one antenna with such a low sensitivity that it only captures the signal from a device located in the box. The system then determines that the mobile device so detected is the one in the box.

Figure 4:
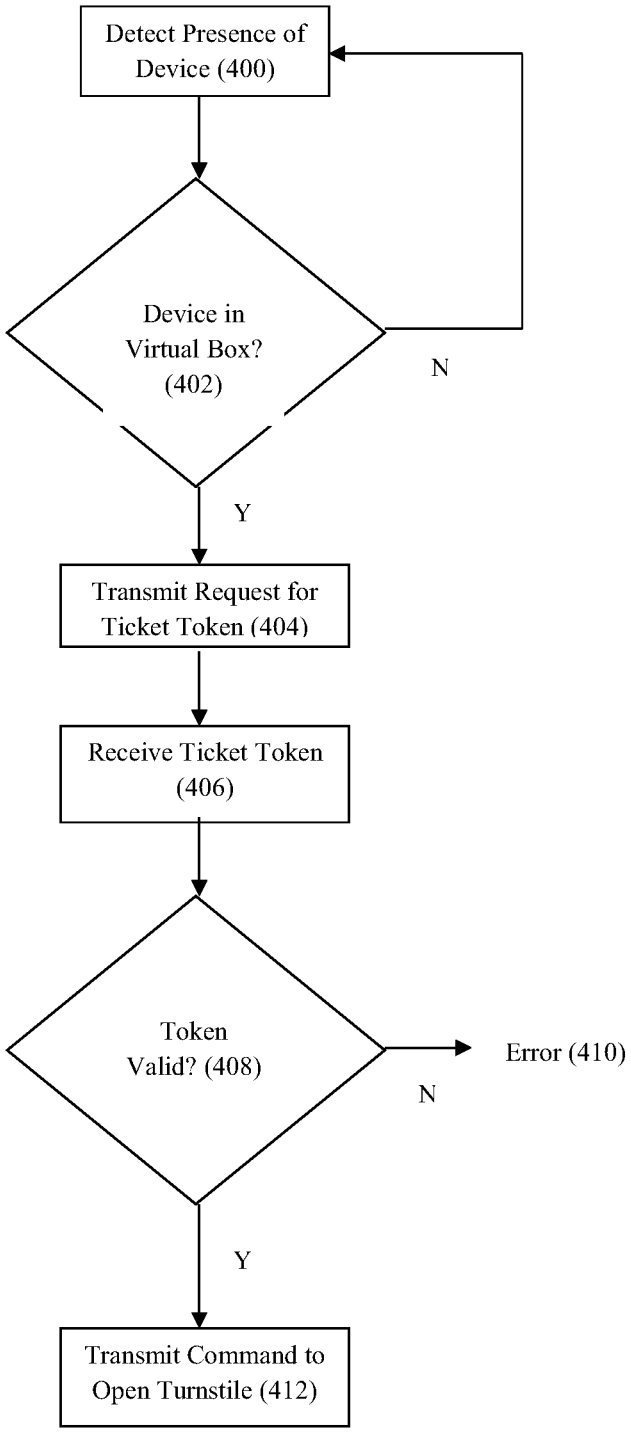

The system can be enhanced by means of the use of ticket validation between the mobile device and the central servers. FIG. 4. In this embodiment, the sensor array or other detector detects a person within the virtual box. As a result, the server transmits a command to the person's mobile device that can be received by any mobile device that is operable to work with the system. This command contains a code representing the venue or service where the device may be used. However, only some of the mobile devices that might receive the command have tickets purchased for the venue. In other embodiments, the server transmits the command through a localized Bluetooth or other similar short-distance connection that is adjusted to be only active with the device in the virtual box. The device determines if it has a ticket corresponding to the broadcast venue identifier at the current time (or near future). At that instant, that mobile device transmits a security token to the server to request entry. The system determines that it is receiving the token from the device in the virtual box by means of the mode of communication. If the token is transmitted through a local Bluetooth connection where the sensitivity of the antenna is tuned to be limited to the virtual box, then only the mobile device in the box is transmitting the token. The server then validates the token, and if validated, transmits a signal to the machinery controlling the entry turnstile in order that it open. As further explained below, a persistent channel may be set up between an application operating on the user's device and the central servers controlling the system to conduct this interaction.

As a further iteration of this concept, the phone as part of the validation process can determine whether the device has more than one valid ticket associated with it and allow for multiple entries if there are multiple tickets available and set for use on the mobile device. This may be used where a parent, who has a mobile phone, is travelling with children.

In another embodiment, Bluetooth LE, wireless proximity analysis, GPS and geo-fencing are used as a form of secondary validation for entry verification. The primary validation methods can include human-based visual validation of a ticket or pass, automated license plate reading, fingerprint scanning, facial recognition, or a unique alphanumeric ID entry via a keyboard or numeric keypad (telephone number generally) as the means of primary ID and the cell phone via Bluetooth LE, wireless proximity analysis, GPS or geofencing validates the individual and the account for the purposes of entry. This can be for toll roads, turnstiles, building security, gym memberships and other venue entry.

Figure 7:
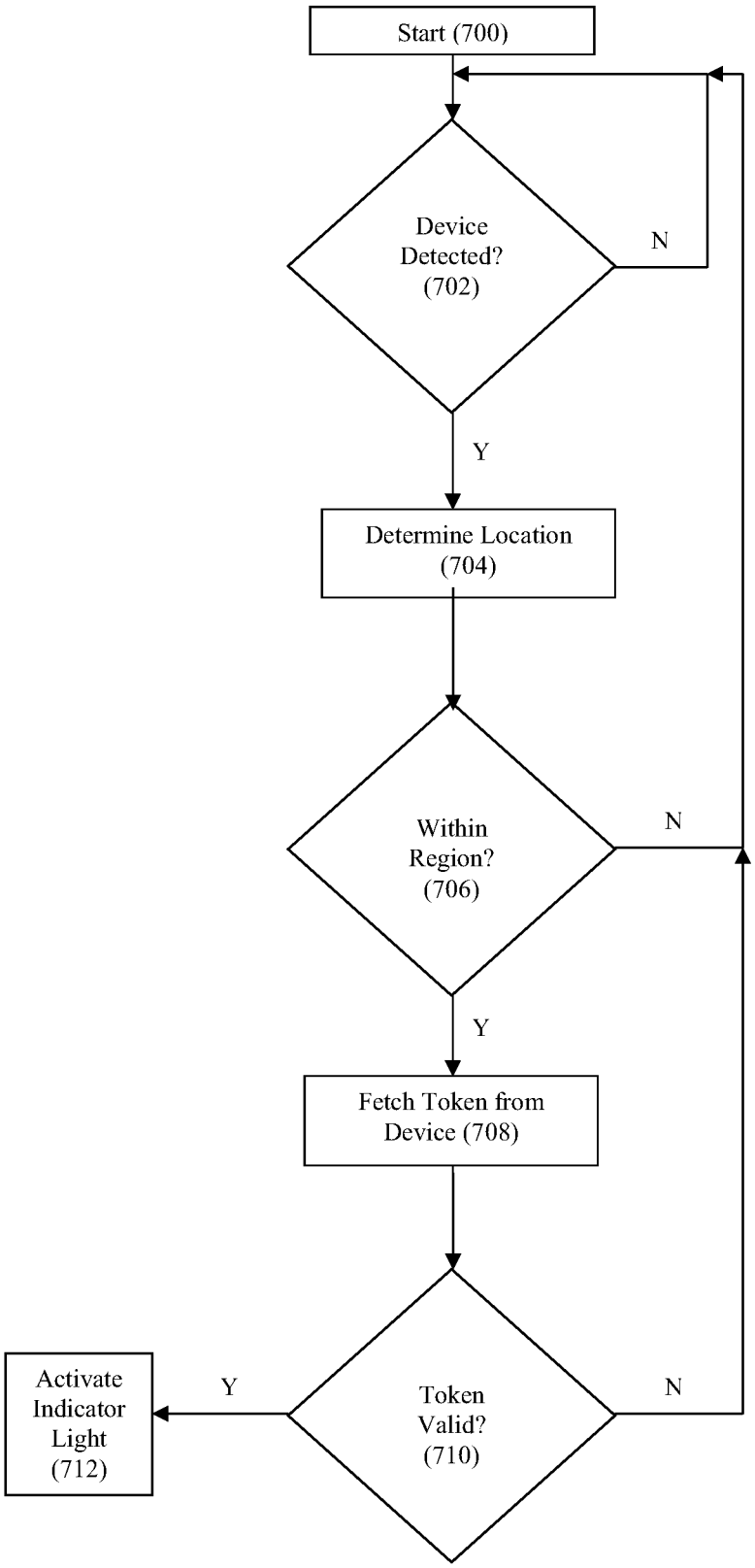

For the purposes of parking, in-car payment verification, restaurant payment validation and ticket validation, a phone using wireless token/key exchange to indicate a successful payment has been completed or that a valid ticket has been activated. This token exchange can occur via NFC, Bluetooth, WiFi or any other radio frequency transmission integrated into the light system. If a valid payment or ticket activation has occurred on the mobile device, the user will be issued a key/token that will allow them to turn a light on at the seat, car or table or indicate on another device display that the validation has occurred (or alternatively, has not occurred). FIG. 7.

If a person uses a cellphone device to pay for a bill at a restaurant, as party of the payment verification, the payment system can transmit to the device a key value from a server that allows the person to activate a light at the table, either by having their device display the value and the person entering the key value number into a keypad that comprises the light, or by means of the cellphone device transmitting the key into the light device, for example by means of a Bluetooth connection. The light could be green (could be any color) to indicate a valid payment has been completed.

Another example is that a person sitting on a train or other transit can use the local ticket verification to actuate a light embedded into the seat in front at its side or otherwise in a position to indicate that the person holds a valid ticket. The person is able to activate the light using the encrypted key transmitted to the phone, which is then locally transmitted to a device controlling the light. When the ticket taker walks through the train car, he does not need to stop at the seats where there is a light indicating a valid ticket holder because that ticket holder has a seat whose valid ticket light has already been activated.

The invention can also be applied to visually impaired persons. A person who is visually impaired would have the capability to get onto a bus, train, or boat and they would receive a vibration or noise on their mobile device to indicate that their ticket has been validated and that they have valid entry. A similar concept can be added for handicap access into transit systems where there are special service doors for disabled passengers to enter and exit a transit system.

Figure 2:
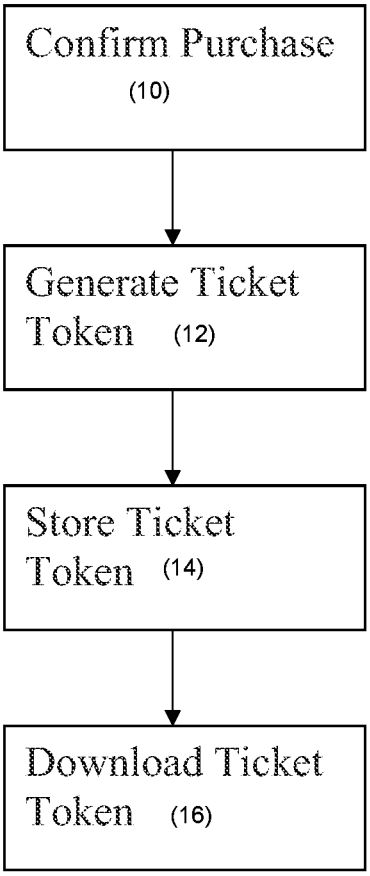

FIG. 2 depicts an electronic ticketing process flow chart, Confirm purchase (10), generate ticket token (12), store ticket token (14) and download ticket token (16).

Figure 5:
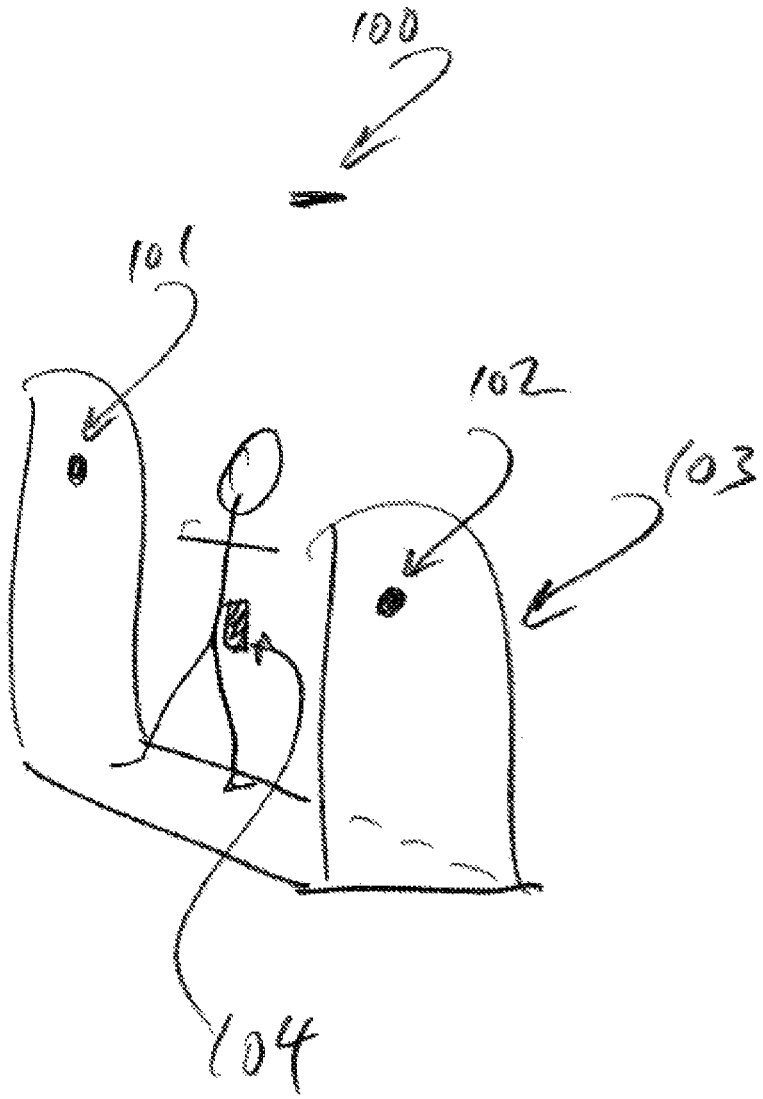
Figure 12:
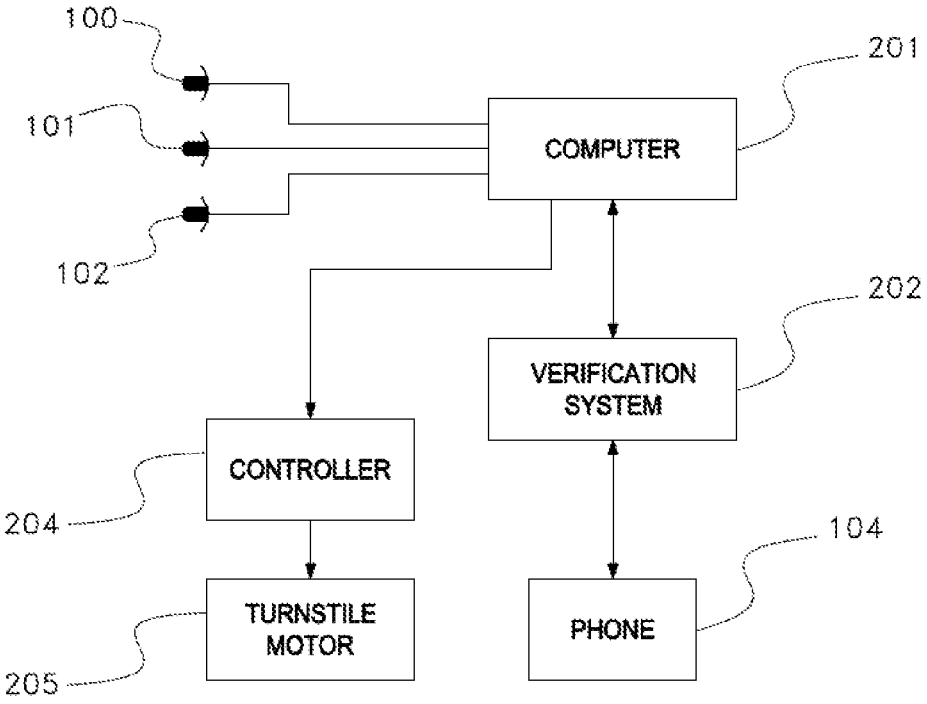
FIG. 12 depicts an example system architecture.

Referring to FIG. 5, the sensor antennas, 100, 101 and 102 are situated in order to be able to detect that the person's mobile device 104, is located within the turnstile region, 104. Referring to FIG. 12, the antennas, 100, 101, 102 are operatively connected to a computer device, which may be a system of several computers that further transmit data, but in any case a system that can use the data received to determine the location. The computer system is operatively connected to the mobile ticketing verification system 202. That system interacts with the mobile phone, 104, in order to provide it a token or otherwise verify that the phone is associated with a valid ticket for the turnstile. Upon validation, the computer device 201, sends a command to a turnstile controller 204, which actuates the turnstile motor, 205. Referring to FIG. 4, the flow chart shows the sequence of logic that may be used in one embodiment, comprising the steps of detect presence of device (400), if yes, is device in virtual box (402), if yes, transmit request for ticket token (404), receive ticket token (406), is token valid (408), if yes, transmit command to open turnstile (412). FIG. 7 depicts a flow chart with start (700), is device detected (702), if yes, determine location (704), is the location within a region (706), if yes, fetch token from device (708), is the token valid (710), if yes activate indicator light (712). Practitioners of ordinary skill will recognize that the specific sequence depicted is not limiting because ticket verification could precede location confirmation, for example.

In this invention, the ticket is procured electronically and stored on the user's device. In one embodiment of the invention, the user purchases a ticket from an on-line website. The website sends to the user's device a unique number, referred to as a token. The token is also stored in the ticketing database. When the time comes to present the ticket, the user's device will have an application that launches a user interface. The user can select "validate" or some other equivalent command to cause the application to fetch and download from the ticketing system a data object referred to herein as a ticket payload, which includes a program to run on the user's device. In another embodiment, the ticket payload can be pushed to the device by the venue. As a result, the application transmitted to the user's device is previously unknown to the user and not resident in the user's device. At that point the user's device can execute the program embodied in the ticket payload, which causes the validation process to occur.

Referring now to FIG. 1, the customer uses their device (1) to purchase a ticket from the service operating the system server (2) and database (3).

Figure 8:
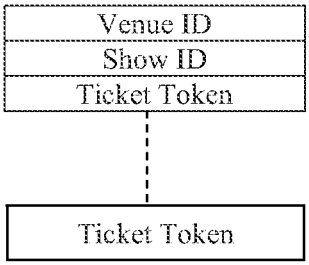

Ticket holders that have purchased tickets have a data record in the system database that contains the unique token associated with the ticket and other relevant information, including the venueID and an identifier identifying the specific show the ticket is for. See FIG. 8. At the entrance, customers are requested to operate an application on their devices. This may be an automatic action resulting from the person carrying the device entering a predetermined area that causes the system to issue a command to the device. This application fetches the stored ticket token and transmits that token to the system, preferably over a secure data channel. The database looks up the token to check that the token is valid for the upcoming show. If the token is valid, then the system transmits back to the device a ticket payload. The ticket payload contains computer code that, when operated, causes the device to communicate via the Bluetooth™ system to the localized distance detector sensors. In another embodiment, the ticket payload has the unique token associated with the ticket. FIG. 9. In this embodiment, the user's device will transmit that token back to local controllers for verification of the ticket.

In one embodiment, the device transmits the ticket token to the system with a command indicating that the ticket has been used. In another embodiment, the customer can operate the application and request that the application transmit to the database the condition that the ticket was used. In that embodiment, the user can input a numeric code or password that the application uses to verify that the customer is confirming use of the ticket. In yet another embodiment, after the ticket has been launched, a predetermined amount of time later it can be deemed used. This condition is useful in cases where the venue checks tickets during shows while letting customers move around the venue's facilities.

In another embodiment, the purchase of the ticket causes the ticket payload to be downloaded to the customer's device. In this case, because a customer may possess the payload some time before its use, precautions must be taken to secure the ticket payload from being hacked so that any similar device can respond to commands from the system to present the token when the device is within the virtual box region associated with the turnstile. While this is a security tradeoff, the benefit is that the customer need not have an Internet connection at a time close to the showtime of the venue.

The use of electronic ticketing provides opportunities that change how tickets can be bought and sold. For example a first customer can purchase a ticket and receive on their device a ticket token. A second customer can purchase that ticket using the system. The first customer can use the application to send a message to the system server indicating that the first customer intends to the web-page indicating that it wants to buy that particular ticket. The system can ask the first customer for a username and password to be associated with the first customer's ticket. If the second customer identifies the first customer's username, the system then can match the two together. At that point, the data record associated with the first customer's ticket is modified so that the ticket token value is changed to a new value. That new ticket token value is then transmitted to the second customer's device. At the same time, the system can operate a typical on-line payment and credit system that secures payment from the second customer and credits the first customer. In one embodiment, the system pays the first customer a discounted amount, retaining the balance as a fee.

In yet another embodiment, the first customer may be unknown to the second customer. In that embodiment, the first customer simply may indicate to the system, through a message transmitted from the application operating on the device or directly through a web-page, that the first customer is not going to use the ticket and wishes to sell it. At that point, the system can mark the data record associated with the ticket as "available for sale." When the second customer makes a request to purchase a ticket for the same show, the system creates a new ticket token for the second customer and updates the ticket token stored in the data record.

In a general admission type of scenario, the ticketing database is simple: each show has a venue ID, some identifier associated with the show itself, various time indicators, the selected validating visual object, and a list of valid ticket tokens. In a reserved seating arrangement, the ticketing database has a data record associated with a show, as indicated by a show identifier, but each seat has a data record that has a unique show identifier and ticket token, which includes the identity of the seat itself.

In the preferred embodiment, the electronic ticket is secured against tampering First, the ticket payload can be secured in a region of the device under the control of the telecommunications provider. In this case, the customer cannot access the code comprising the ticket payload. In another embodiment, the ticket payload can be encrypted in such a way that the only decrypting key available is in the secure portion of the telecommunications device. In that embodiment, the key is only delivered when an application running on the secure part of the device confirms that the ticket payload that is executing has not been tampered with, for example, by checking the checksum of its run-time image. At that point, the key can be delivered to the ticket payload process so that the proximity detection and validation can occur.

Second, the code that operates to conduct the proximity detection and validation process itself operates certain security protocols. The phone transmits a ticket transaction request. The request includes a numeric value unique to the device, for example, an IMEI number. Other embodiments use the UDID or hardware serial number of the device instead of or in combination with the IMEI number. The system server then generates the ticket token using the IMEI number and transmits that value to that device. In addition, the ticket payload is created such that it expects to read the correct IMEI number. This is accomplished by the system server changing portions of the ticket payload so that the it is customized for each individual IMEI number associated with a ticket token. The code comprising the ticket payload is designed so that it has to obtain the correct IMEI number at run time. In another embodiment, at run-time, the device application code will read the particular ticket token specific for the phone that instance of the ticket was transmitted to. The code will then decode the token and check that it reflects the correct IMEI number for that device.

In another embodiment, the security protocol first requires the user to login to the server with a login username and password. The application also transmits the IMEI, UDID or serial number of the device or any combination of them. When verified by the server, an authorization key (Authkey) is transmitted to the device. The Authkey is a random number. When the user's application transmits a request for a validating visual object, it transmits the Authkey and the IMEI, UDID or serial number (or combination) that is used for verification. This is checked by the server for validity in the database. On verification, the object ticket is encrypted using the Authkey and transmitted to the device. The application running on the device then uses the Authkey to the proximity detection and verification protocol with the turnstile. The Authkey is a one-time key. It is used once for each ticket payload. If a user buys a second ticket from the system, a different, second Authkey is associated with that second ticket payload. In one embodiment, the Authkey is unique to the ticket for a given event. In another embodiment, the Authkey is unique to the ticket, device and the event. In other embodiments, the Authkey can be replaced with a key-pair in an asymmetric encryption system. In that case, the electronic ticket is encrypted with a "public" key, and then each user is issued a private key as the "Authkey" to be used to decrypt the object.

In yet another embodiment, the Authkey can be encrypted on the server and transmitted to the device in encrypted form. Only when the application is operating can the Authkey be decrypted with the appropriate key. In yet another embodiment, the application that operates the proximity protocol and verification can request a PIN number or some other login password from the user, such that if the device is lost, the tickets cannot be used by someone who finds the device.

In another embodiment, the application running on the device can fetch a dynamic script, meaning a piece of code that has instructions arranged in a different order for subsets of devices that request it. The ticket payload is then modified so as to have the same number of versions that are compatible with a corresponding variation in the dynamic script. As a result, it is difficult to reverse engineer the application because the application will be altered at run time and the ticket payload customized for that alteration. One embodiment of the dynamic script would be expressed in Java™ computer language. The ticket payload can be an HTML file called using Ajax.

Security can also be enhanced by actively destroying the ticket so that it resides in the device for a limited time. In one embodiment, the ticket payload has a time to kill parameter that provides the application with a count-down time to destroy the validating visual object. In another embodiment, the validating visual object is displayed when the user holds down a literal or virtual button on the user interface of the device. When the button is released, the application destroys the validating visual object.

In yet another embodiment, the verification can be supplemented by being sure that the use of the ticket is during a pre-determined period of time. In yet another embodiment, the verification can be supplemented by the ticket payload operating to check that the location of the venue where the ticket is being used is within a pre-determined range of tolerance to a GPS (Global Positioning System) location.

Figure 3:
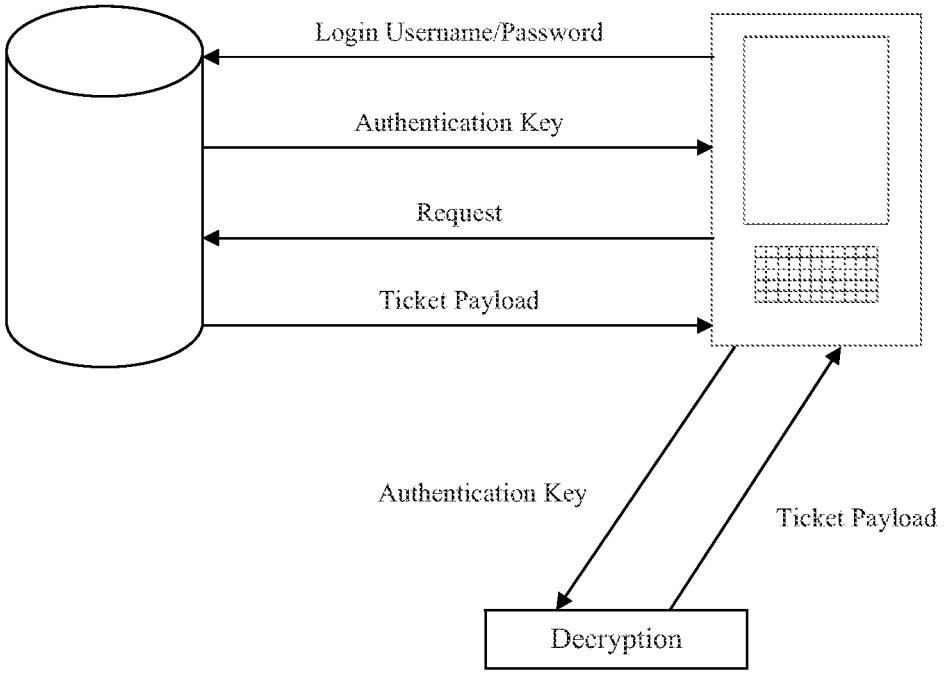

In yet another embodiment, the system's servers control the ticket activation process. FIG. 3. In this embodiment, the token is generated randomly by the user's mobile computing device and then transmitted to and stored on the system server as a result of the user's request to activate the ticket. When the server receives a request to activate a ticket, the server checks whether there is already an activation token stored in its database that corresponds to that ticket. The token is stored in a data record associated with the user that is activating the ticket. The user logs into the account and then requests that a ticket be activated. If it is, then it checks whether the token received from the user's mobile device matches the stored token. That is, it authenticates against that stored token. If the user's request for activation is the first activation of the ticket, then the server stores the received token into the data record associated with the user's account and keeps it there for a predetermined period of time, in order to lock the ticket to that device for that period of time. This process locks a ticket to that unique token for that lock period. Typically this will lock the ticket to the user's mobile computing device. If the stored token does not match the token received from the user's computing device, the ticket activation is denied.

The predetermined lock time permits a reusable ticket to be locked to a device for the predetermined lock time. This is useful in the event the user changes the mobile computing device that the user uses to the ticket. For example, a monthly train commuting ticket would be activated once each day, and would remain activated for the day of its activation. In this case, the user would validate the ticket once each day, and that activation would be locked to the device for the day. The next day, the user would be able to activate the ticket using a different mobile computing device if the predetermined time locking the activation has expired, that is, if the data record associated with the ticket has been automatically reset into an deactivated state. The activation process also permits a user account to be shared within a family, for instance, but that each ticket sold to that account to be locked to one device.

Figure 11A:
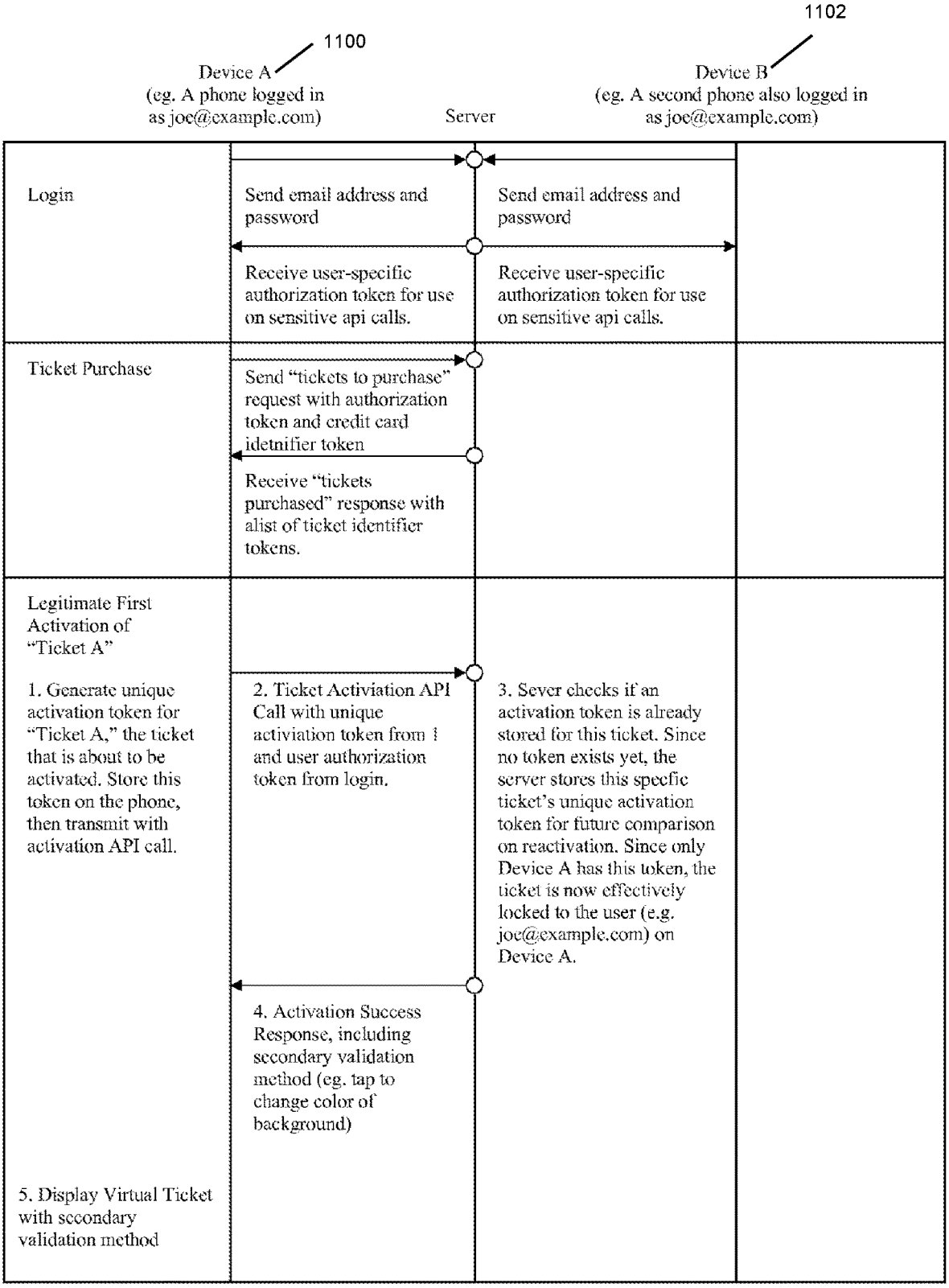
FIGS. 11*a* and 11*b* depict protocol diagrams for the activation process.
Figure 11B:
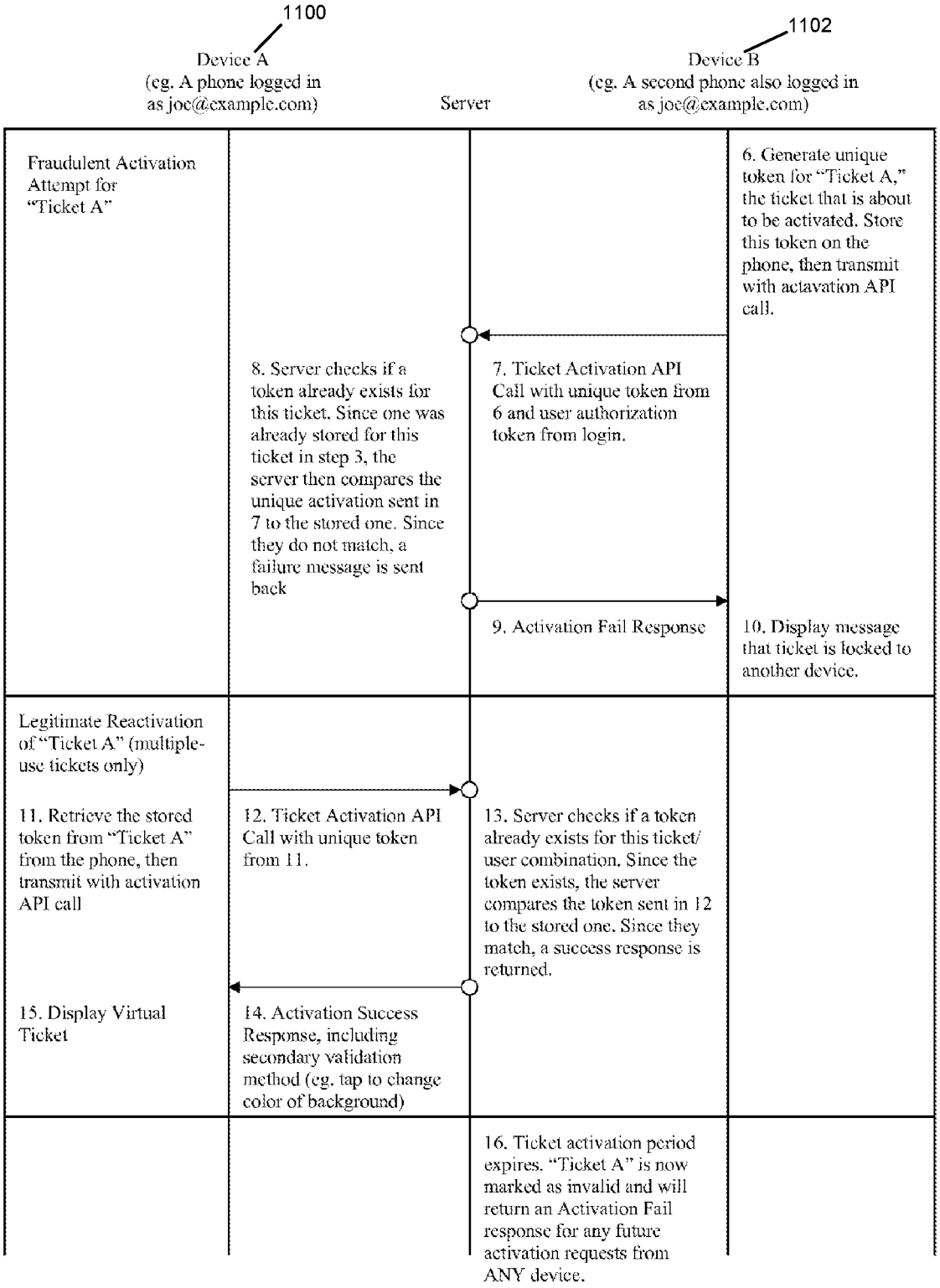

As depicted in the protocol diagrams FIGS. 11*a* and 11*b*, the user can use their mobile computing device (for example for Device A (1100) and Device B (1102)) to request that their ticket get activated for the first time. However, once that activation process has occurred, the server will store the unique token received from the activating user's computing device in the database in a manner that associates it with the ticket and the user's account. If another user associated with the account attempts to use the ticket by activating it, a different random token will be transmitted to the server. Because these two tokens do not match, the second activation will be prohibited.

The activation process can also permit a ticket to be shared. In this embodiment, the user who has activated the ticket can submit to the server a request that the ticket be transferred to another user. For example, a data message can be transmitted from the user's device to the system that embodies a request to move the ticket to another user. In that case, the stored token is marked as blocked, or is equivalently considered not present. This is accomplished by storing a data flag in the database that corresponds to the ticket. One logic state encodes normal use and the opposite logic state encodes that the ticket has been shared. A data message may be transmitted to the second user indicating that the ticket is available for activation. The second user may submit a request to activate the ticket and a random token value is transmitted from the second user's device to the server. That second token value is checked to see if it's the first activation. Because the first user has activated the ticket, but then transferred it, the activation by the second user is not blocked. That is, the server detects that the first token is now cancelled or equivalently, the system has returned to the state where the first activation has not occurred and therefore permits the new activation to take place. The new activation can also have a predetermined time to live value stored in the database that is associated with it. In this case, the activation by the second user expires and the second user can be prevented from reactivating the ticket. At the same time, the flag setting that disables the first token can be reset, thereby setting the ticket up for reactivation by the first user. By this mechanism, it is possible for the electronic ticket to be lent from one user to another.

In yet another embodiment, the ticket activation process can open a persistent connection channel over the data network that links the server and the user's mobile computing device. In this embodiment, if the activation of the ticket and therefore the device is successful, the server can maintain a persistent data channel with a computer process running on the user's computing device. In this embodiment, the request for ticket activation causes the user computer device to open the persistent channel. In this embodiment, the server establishes a communication process operating on the server that receives data and then causes that data to be automatically routed to the user's computing device. The process on the user's mobile computing device can thereby automatically respond to that received data. In tandem, the computer process operating on the users computing device can send data directly to the server process associated with that user's session. For a server servicing many user devices, there will be one persistent channel established between the server and each mobile device that has an activated ticket.

The persistent channel between the server and the user's computer device can be used in a variety of ways. In the preferred embodiment, the persistent connection is designed so that that it maintains a bi-directional, full-duplex communications channel over a single TCP connection. The protocol provides a standardized way for the server to send content to the process operating on the user's computing device without being solicited by the user's device each time for that information, and allowing for messages to be passed back and forth while keeping the connection open. In this way a two-way (bi-direction) ongoing interaction can take place between a process operating on the user's computing device the server. By means of the persistent channel, the server can control the activity of the user computer device. For each user computing device, there can be a distinct persistent connection.

Figure 10:
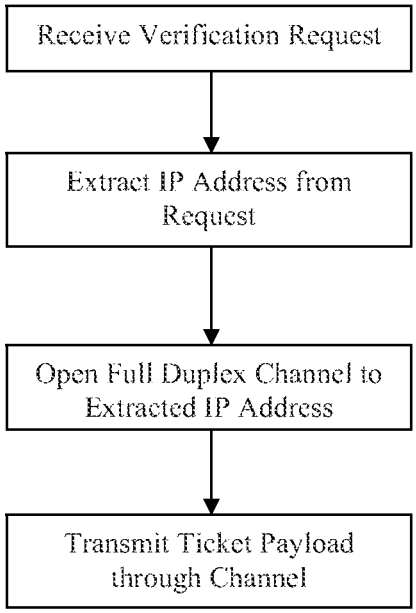

In one embodiment, the persistent connection is established when the user requests an activation of a ticket. See FIG. 10. In other embodiments, it can be used if the system is used to verify payment of a purchase price. In either case, the user computing device transmits a request message to the server. For each user computing device, there can be a distinct persistent channel. Each persistent channel has a label or channel name that can be used by the server to address the channel. In the case of ticketing, when the ticket is activated the data representing the ticket can be transmitted in real time from the server to the user computing device and immediately transmitted to the sensors controlling the entry device. This provides an additional method of securing the ticketing process. In this case, when the ticket is activated and the persistent channel is created, the label of the channel is stored in the database in a data record associated with the user and the ticket. When the server transmits the validating token for that ticket, it fetches from the database the label of the channel and then uses that label to route the transmission of the validating token. The use of the persistent channel causes the user computer device to immediately and automatically act on the validating token. In one embodiment, the receipt of the validating token causes the receiving process to immediately in response interpret the command and transmit the token through a local network to the sensors. For example, a token may be requested and received using a cellular data network and then the token transmitted to the gate sensors using Bluetooth. In another embodiment, the process receives a block of code that the process calls on to execute, and that code causes the validating token to be transmitted. In the preferred embodiment, the persistent channel is established only for the mobile device that is within the virtual box region. In yet another embodiment, the persistent channel can be established to a plurality of mobile devices that may be adjacent to the virtual box so that the system can prepare these devices for the last proximity and validation process when they occupy the virtual box associated with the turnstile.

In yet another embodiment, the persistent connection provides a means for the server to control the actions of the process operating on the user's computer device that is at the other end of the connection. In this embodiment, the server can automatically transmit a command to the process on the user's computing device that automatically deletes the verifying token that has been transmitted to ensure that it cannot be reused or copied.

In one embodiment, the persistent connection is used to automatically transmit visual or audio information to the user's mobile computing device and to cause that information to be displayed on the screen of the device. The visual information can be the validating visual object or any other visual object that the server selects to transmit for display. In this embodiment, the persistent connection can be used by the server to transmit other information to the user's device. In this embodiment, the server transmits text, images, video or sound and in some cases in combination with other HTML data. In another embodiment, this material comprises advertising that the server selects to display on the user's device. The selection process can utilize the GPS feature described above to determine the approximate location of the user's device and then based on that location, select advertising appropriate to be transmitted to that device. In yet another embodiment, the server selects the advertising content by determining predetermined features of the validated ticket or purchasing transaction and then making a selection on the basis of those features. For example, a validation of a ticket to a baseball game played by a team specified in the data associated with the validated ticket may cause the selection of an offer to purchase a ticket for the next baseball game of the same team. In yet another embodiment, the character of the transaction being verified can be used to cause the selection of advertising or the transmission of data comprising a discount offer related to the transaction.

In this embodiment, the server receives from the merchant the data that determines the persistent channel. The merchant, by relying on the system for payment will also transmit transaction details, for example, an amount of money and an identity of goods or services. When the channel name or unique number associated with the channel is matched for verification, the server can transmit data representing a confirmation display down to the user's device using the persistent connection. This data is received by the user computing device and then automatically rendered by the process at the other end of the channel connection. In addition, the server can use the transaction information to determine one or more advertisements or discount offers to transmit to the user's computing device. The selection method can consist of one or more heuristics. In one example, the validation of the ticket for a baseball game can trigger the display of advertising for food or drinks. Likewise, a transaction for purchasing a cup of coffee can trigger an advertisement for purchasing a newspaper.

Operating Environment:

The system operates on one or more computers, typically one or more file servers connected to the Internet. The system is typically comprised of a central server that is connected by a data network to a user's computer. The central server may be comprised of one or more computers connected to one or more mass storage devices. A website is a central server that is connected to the Internet. The typical website has one or more files, referred to as web-pages, that are transmitted to a user's computer so that the user's computer displays an interface in dependence on the contents of the web-page file. The web-page file can contain HTML or other data that is rendered by a program operating on the user's computer. That program, referred to as a browser, permits the user to actuate virtual buttons or controls that are displayed by the browser and to input alphanumeric data. The browser operating on the user's computer then transmits values associated with the buttons or other controls and any input alphanumeric strings to the website. The website then processes these inputs, in some cases transmitting back to the user's computer additional data that is displayed by the browser. The precise architecture of the central server does not limit the claimed invention. In addition, the data network may operate with several levels, such that the user's computer is connected through a fire wall to one server, which routes communications to another server that executes the disclosed methods. The precise details of the data network architecture does not limit the claimed invention. Further, the user's computer may be a laptop or desktop type of personal computer. It can also be a cell phone, smart phone or other handheld device. The precise form factor of the user's computer does not limit the claimed invention. In one embodiment, the user's computer is omitted, and instead a separate computing functionality provided that works with the central server. This may be housed in the central server or operatively connected to it. In this case, an operator can take a telephone call from a customer and input into the computing system the customer's data in accordance with the disclosed method. Further, the customer may receive from and transmit data to the central server by means of the Internet, whereby the customer accesses an account using an Internet web-browser and browser displays an interactive webpage operatively connected to the central server. The central server transmits and receives data in response to data and commands transmitted from the browser in response to the customer's actuation of the browser user interface.

A server may be a computer comprised of a central processing unit with a mass storage device and a network connection. In addition a server can include multiple of such computers connected together with a data network or other data transfer connection, or, multiple computers on a network with network accessed storage, in a manner that provides such functionality as a group. Practitioners of ordinary skill will recognize that functions that are accomplished on one server may be partitioned and accomplished on multiple servers that are operatively connected by a computer network by means of appropriate inter process communication. In addition, the access of the website can be by means of an Internet browser accessing a secure or public page or by means of a client program running on a local computer that is connected over a computer network to the server. A data message and data upload or download can be delivered over the Internet using typical protocols, including TCP/IP, HTTP, SMTP, RPC, FTP or other kinds of data communication protocols that permit processes running on two remote computers to exchange information by means of digital network communication. As a result a data message can be a data packet transmitted from or received by a computer containing a destination network address, a destination process or application identifier, and data values that can be parsed at the destination computer located at the destination network address by the destination application in order that the relevant data values are extracted and used by the destination application.

It should be noted that the flow diagrams are used herein to demonstrate various aspects of the invention, and should not be construed to limit the present invention to any particular logic flow or logic implementation. The described logic may be partitioned into different logic blocks (e.g., programs, modules, functions, or subroutines) without changing the overall results or otherwise departing from the true scope of the invention. Oftentimes, logic elements may be added, modified, omitted, performed in a different order, or implemented using different logic constructs (e.g., logic gates, looping primitives, conditional logic, and other logic constructs) without changing the overall results or otherwise departing from the true scope of the invention.

The method described herein can be executed on a computer system, generally comprised of a central processing unit (CPU) that is operatively connected to a memory device, data input and output circuitry (IO) and computer data network communication circuitry. Computer code executed by the CPU can take data received by the data communication circuitry and store it in the memory device. In addition, the CPU can take data from the I/O circuitry and store it in the memory device. Further, the CPU can take data from a memory device and output it through the IO circuitry or the data communication circuitry. The data stored in memory may be further recalled from the memory device, further processed or modified by the CPU in the manner described herein and restored in the same memory device or a different memory device operatively connected to the CPU including by means of the data network circuitry. The memory device can be any kind of data storage circuit or magnetic storage or optical device, including a hard disk, optical disk or solid state memory.

Examples of well known computing systems, environments, and/or configurations that may be suitable for use with the invention include, but are not limited to, personal computers, server computers, hand-held, laptop or mobile computer or communications devices such as cell phones and PDA's, multiprocessor systems, microprocessor-based systems, set top boxes, programmable consumer electronics, network PCs, minicomputers, mainframe computers, distributed computing environments that include any of the above systems or devices, and the like.

Computer program logic implementing all or part of the functionality previously described herein may be embodied in various forms, including, but in no way limited to, a source code form, a computer executable form, and various intermediate forms (e.g., forms generated by an assembler, compiler, linker, or locator.) Source code may include a series of computer program instructions implemented in any of various programming languages (e.g., an object code, an assembly language, or a high-level language such as FORTRAN, C, C++, JAVA, or HTML) for use with various operating systems or operating environments. The source code may define and use various data structures and communication messages. The source code may be in a computer executable form (e.g., via an interpreter), or the source code may be converted (e.g., via a translator, assembler, or compiler) into a computer executable form.

The invention may be described in the general context of computer-executable instructions, such as program modules, being executed by a computer. Generally, program modules include routines, programs, objects, components, data structures, etc., that perform particular tasks or implement particular abstract data types. The computer program and data may be fixed in any form (e.g., source code form, computer executable form, or an intermediate form) either permanently or transitorily in a tangible storage medium, such as a semiconductor memory device (e.g., a RAM, ROM, PROM, EEPROM, or Flash-Programmable RAM), a magnetic memory device (e.g., a diskette or fixed hard disk), an optical memory device (e.g., a CD-ROM or DVD), a PC card (e.g., PCMCIA card), or other memory device. The computer program and data may be fixed in any form in a signal that is transmittable to a computer using any of various communication technologies, including, but in no way limited to, analog technologies, digital technologies, optical technologies, wireless technologies, networking technologies, and internetworking technologies. The computer program and data may be distributed in any form as a removable storage medium with accompanying printed or electronic documentation (e.g., shrink wrapped software or a magnetic tape), preloaded with a computer system (e.g., on system ROM or fixed disk), or distributed from a server or electronic bulletin board over the communication system (e.g., the Internet or World Wide Web.) It is appreciated that any of the software components of the present invention may, if desired, be implemented in ROM (read-only memory) form. The software components may, generally, be implemented in hardware, if desired, using conventional techniques.

The invention may also be practiced in distributed computing environments where tasks are performed by remote processing devices that are linked through a communications network. In a distributed computing environment, program modules may be located in both local and remote computer storage media including memory storage devices. Practitioners of ordinary skill will recognize that the invention may be executed on one or more computer processors that are linked using a data network, including, for example, the Internet. In another embodiment, different steps of the process can be executed by one or more computers and storage devices geographically separated by connected by a data network in a manner so that they operate together to execute the process steps. In one embodiment, a user's computer can run an application that causes the user's computer to transmit a stream of one or more data packets across a data network to a second computer, referred to here as a server. The server, in turn, may be connected to one or more mass data storage devices where the database is stored. The server can execute a program that receives the transmitted packet and interpret the transmitted data packets in order to extract database query information. The server can then execute the remaining steps of the invention by means of accessing the mass storage devices to derive the desired result of the query. Alternatively, the server can transmit the query information to another computer that is connected to the mass storage devices, and that computer can execute the invention to derive the desired result. The result can then be transmitted back to the user's computer by means of another stream of one or more data packets appropriately addressed to the user's computer.

The described embodiments of the invention are intended to be exemplary and numerous variations and modifications will be apparent to those skilled in the art. All such variations and modifications are intended to be within the scope of the present invention as defined in the appended claims. Although the present invention has been described and illustrated in detail, it is to be clearly understood that the same is by way of illustration and example only, and is not to be taken by way of limitation. It is appreciated that various features of the invention which are, for clarity, described in the context of separate embodiments may also be provided in combination in a single embodiment. Conversely, various features of the invention which are, for brevity, described in the context of a single embodiment may also be provided separately or in any suitable combination. It is appreciated that the particular embodiment described in the specification is intended only to provide an extremely detailed disclosure of the present invention and is not intended to be limiting.

Modifications of the above disclosed apparatus and methods which fall within the scope of the invention will be readily apparent to those of ordinary skill in the art. Accordingly, while the present invention has been disclosed in connection with exemplary embodiments thereof, it should be understood that other embodiments may fall within the spirit and scope of the invention, as defined by the following claims.

What is claimed:

1. A system for monitoring permission for persons to be in a location comprising:

a computer system connected by a data network to a system database comprised of data records representing purchased tickets, wherein the data record contains at least one stored ticket token associated with, at least, a purchased ticket and a person; and one or more bluetooth antenna devices operatively connected to the computer system, wherein the bluetooth antenna devices in combination with the computer system are adapted to detect the presence of a mobile device within a predetermined region and in dependence on such determination, initiate a ticket validation process with the mobile device in order to verify that the mobile device is associated with a valid ticket, wherein the ticket validation process includes the following:

determining a location of the mobile device as a function of a ratio of measured signal intensities from each of the one or more Bluetooth antenna devices, transmitting by the mobile device a security token to the computer system to request entry only when the location of the bluetooth antenna indicates the mobile device is in the predetermined region, wherein the security token is transmitted through a local Bluetooth connection and the security token is validated by matching the stored ticket token in the data record and the security token transmitted by the mobile device and only upon validation transmitting the following:

a program code to the mobile device, wherein the program code has been customized for the mobile device and is configured to be automatically executed by the mobile device, and wherein the program code, upon execution by the mobile device, causes the mobile device to communicate with an entry turnstile in the predetermined region using a wireless connection for permission to allow a person possessing the mobile device to enter through the turnstile, and a signal to machinery controlling the entry turnstile to cause the turnstile to open.

2. A method of validating an electronic ticket associated with a predetermined service, wherein said ticket is stored on a mobile device, and wherein said method comprises:

receiving an indication from at least one bluetooth antenna device representing the presence of the mobile device within a predetermined region by determining a location of the mobile device as a function of a ratio of measured signal intensities from each of the one or more Bluetooth antenna devices, the predetermined region being a position that the device must be located in to gain access to the service;

in response to receiving the indication, sending a request to the mobile device to send a token representing the stored electronic ticket;

transmitting by the mobile device a security token to the computer system to request entry, wherein the security token is transmitted through a local Bluetooth connection, receiving, in a system server, the security token from the mobile device;

verifying the validity of the security token by matching a stored ticket token in a data record in a database to the security token from the mobile device; and only upon verification of the security token, transmitting a program code from the system server to the mobile device, wherein the program code has been customized for the mobile device and is configured to be automatically executed by the mobile device, and wherein the program code, upon execution by the mobile device, causes the mobile device to wirelessly communicate with an entry device in the predetermined region for permission to allow the person possessing the mobile device to enter to use the service associated with the electronic ticket.

3. The method of claim 2 where the transmitting step is comprised of transmitting a command to release the entry device in order to permit entry by the mobile device present in the predetermined region.

4. The method of claim 3 where the entry device is a turnstile.

5. The method of claim 2, wherein the program code has been customized to include an identification number specific to the mobile device only.

6. The method of claim 2, wherein the mobile device communicates with the entry device using a Bluetooth connection.

* * * * *